US005588548A

United States Patent [19]

Brankley

[11] Patent Number: 5,588,548

[45] Date of Patent: Dec. 31, 1996

[54] ADJUSTABLE BABY BOTTLENECK

[76] Inventor: Jacob R. Brankley, 10509 Qualla Rd., Chesterfield, Va. 23832

[21] Appl. No.: 460,594

[22] Filed: Jun. 2, 1995

[51] Int. Cl.[6] ..... A61J 9/00; B65D 25/48

[52] U.S. Cl. ..... 215/388; 215/11.1; 215/11.3

[58] Field of Search ..... 215/11.1, 11.3, 215/11.6, 388; 248/102, 104

[56] References Cited

U.S. PATENT DOCUMENTS

| | | | |
|---|---|---|---|
| 3,071,272 | 1/1963 | Doner | 215/11.1 |
| 3,076,574 | 2/1963 | Woodbury, Jr. | 215/11.1 |
| 3,143,429 | 8/1964 | Swanson et al. | 215/11.3 X |
| 3,323,669 | 6/1967 | Yazaki | 215/11.1 |
| 3,851,781 | 12/1974 | Marco | 215/11.3 |
| 4,501,585 | 2/1985 | Friedman et al. | 215/11.3 X |
| 4,676,387 | 6/1987 | Stephenson et al. | 215/11.1 |
| 4,813,556 | 3/1989 | Lawrence | 215/11.1 X |
| 4,898,290 | 2/1990 | Cueto | 215/388 X |
| 4,928,836 | 5/1990 | Wu et al. | 215/11.5 |
| 4,969,564 | 11/1990 | Cohen et al. | 215/11.1 |
| 5,190,174 | 3/1993 | Klag | 215/11.1 |
| 5,211,298 | 5/1993 | Block | 215/11.1 |
| 5,234,117 | 8/1993 | Garvin | 215/11.1 X |
| 5,421,496 | 6/1995 | Korsinsky et al. | 215/11.1 X |
| 5,429,254 | 7/1995 | Christine | 215/11.1 |

FOREIGN PATENT DOCUMENTS

| | | | |
|---|---|---|---|
| 994375 | 11/1951 | France | 248/104 |
| 419228 | 10/1925 | Germany | 215/11.4 |
| 2067416 | 7/1981 | United Kingdom | 215/11.4 |
| 2109247 | 6/1983 | United Kingdom | 215/11.6 |

*Primary Examiner*—Sue A. Weaver
*Attorney, Agent, or Firm*—Breneman & Georges

[57] ABSTRACT

An adjustable baby bottleneck is provided for connecting a conventional infant bottle 20 to a conventional baby nipple 22 through an angular or adjustable bottleneck portion 24 for transforming standard baby bottles into an improved device for feeding infants. The angularly adjustable bottleneck portion may be either set and fixed from an angle of 0 to 60 degrees and includes a mounted securing ring 46 at one end for mating with the top of a standard baby nursing bottle and at the other end includes means for mating with a standard nipple with an adjustable portion disposed between the bottle mating and nipple mating ends of the adjustable baby bottleneck. The angularly adjustable configuration of the adjustable baby bottleneck and internal channelling provides feeding advantages for the infant over a wide range of feeding positions to reduce burping, belching and infant colic resulting from the introduction of air from either the inside of the bottle or sides of the nipple during feeding irrespective of the feeding position of the infant.

20 Claims, 7 Drawing Sheets

FIG. 5
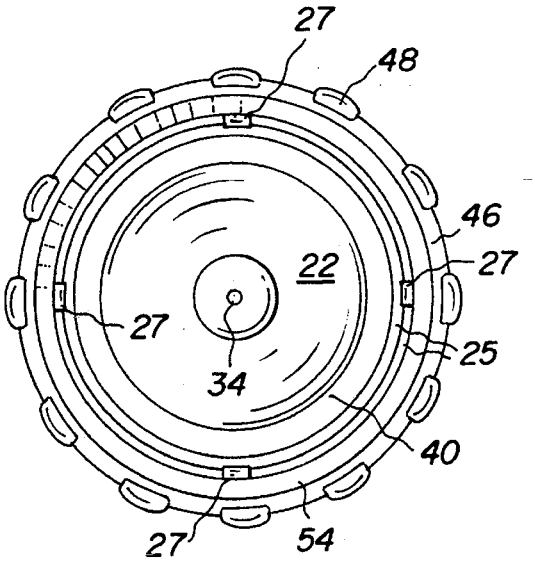
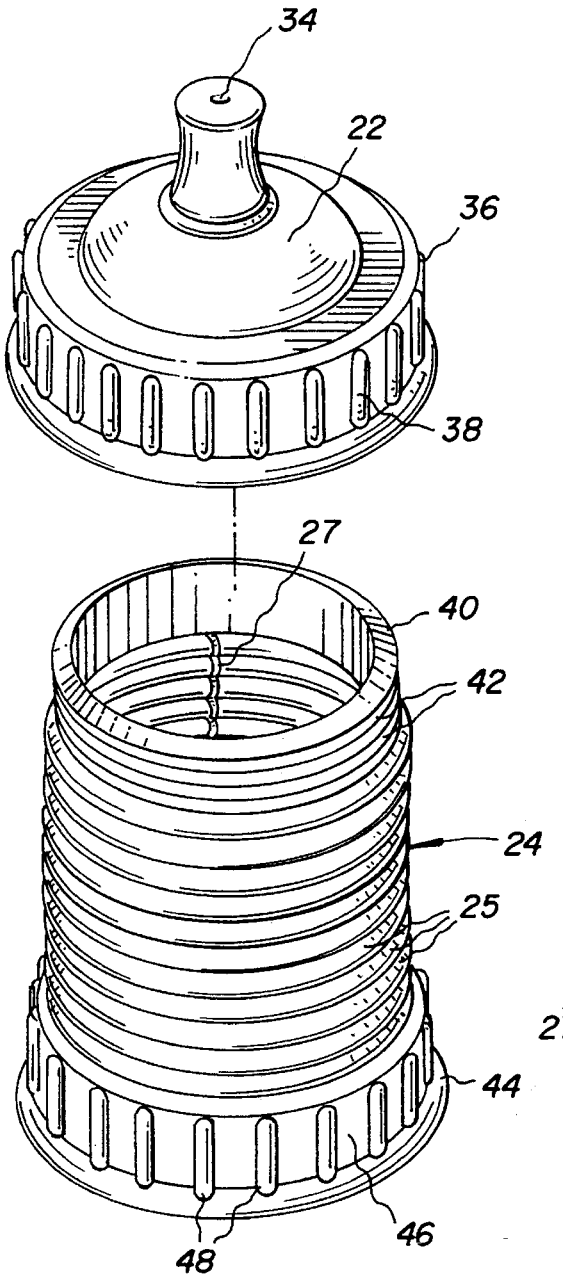
FIG. 4
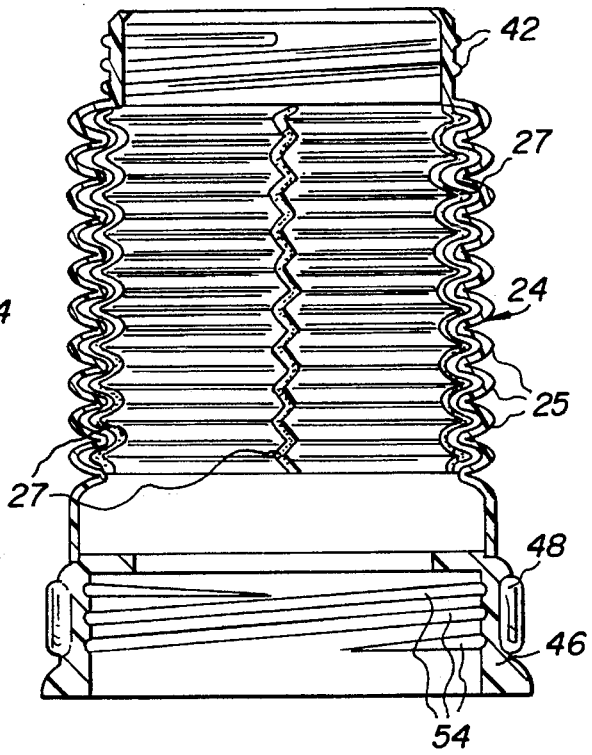
FIG. 6

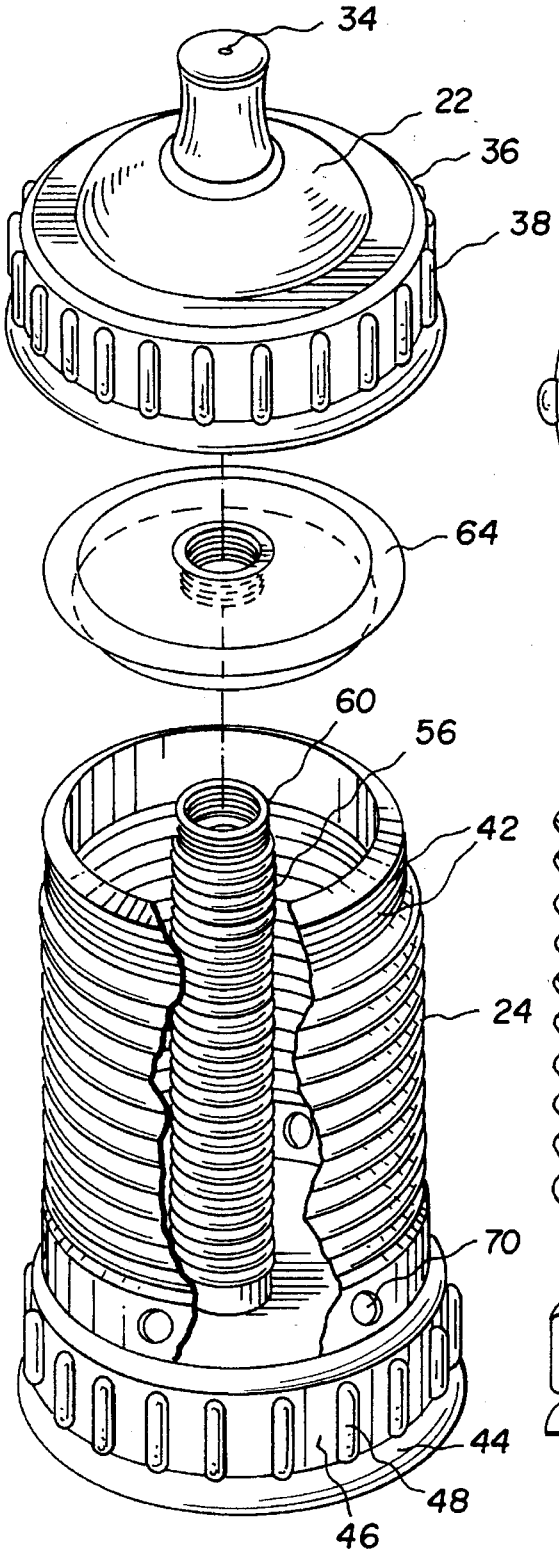
FIG. 10
FIG. 11
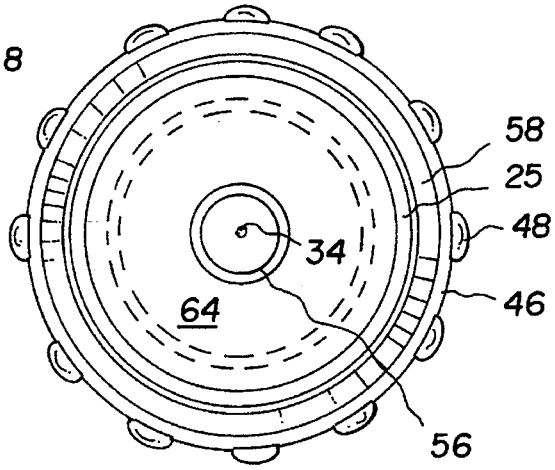
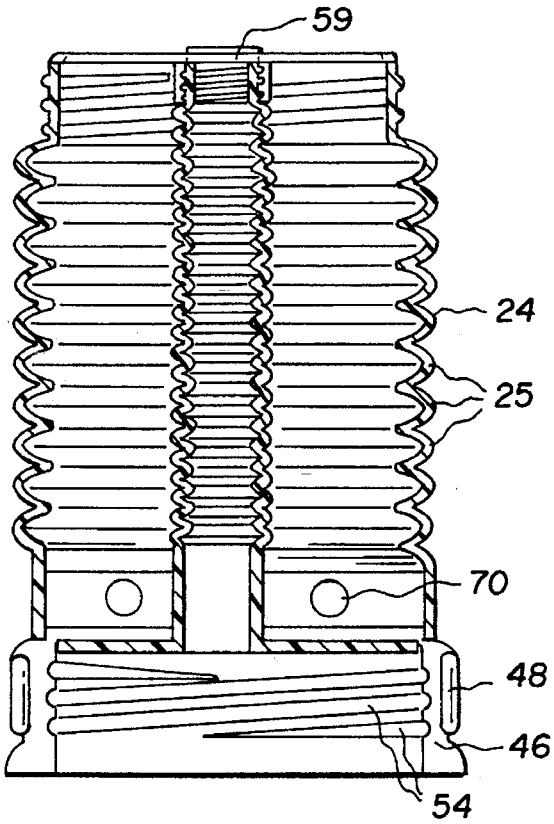
FIG. 12

ADJUSTABLE BABY BOTTLENECK

BACKGROUND OF THE INVENTION

1. Field Of The Invention

The present invention pertains to a baby bottleneck for mounting between a standard baby bottle and a standard baby bottle nipple which allows the neck portion to be angularly maintained to provide a more natural flow of foods to nursing infants.

More particularly the invention pertains to an adjustable baby bottleneck which accepts on one end a standard infant nursing bottle and at the other end accepts a standard infant nursing nipple and which between the two ends of the adjustable bottleneck provides an angular setting from between 0 degrees to 60 degrees to provide a more natural delivery of food to nursing infants to accommodate a variety of feeding positions of nursing infants.

The adjustability and setting of the baby bottleneck as well as its adaption to the use of disposable liners allows the utilization of standard baby bottles and the use of standard infant nipples which can be easily cleaned and sterilized with the adjustable baby bottleneck. The adjustability and setting of the neck portion as well as the utilization of the tapered and offset channelling passage reduces the amount of air drawn into the baby's stomach during feeding through either the bottle or around the sides of the standard nipple.

2. Description Of The Prior Art

With respect to the known prior art reference has been made to Stephenson, et al. U.S. Pat. No. 4,676,387, Klag U.S. Pat. No. 5,190,174, Cohen, et al. U.S. Pat. No. 4,969,564, Garvin U.S. Pat. No. 5,234,117, Wu, et al. U.S. Pat. No. 4,928,836 and Lawrence U.S. Pat. No. 4,813,556. These prior art devices and references generally recognize the advantages of having the nipple in non-axial alignment with the bottle to provide advantages in infant feeding to reduce the amount of air drawn by the infant through the bottle. The amount of air drawn into a baby's stomach during feeding is not limited to air drawn through the bottle but also includes air drawn from around the sides of the nipple at the interface between the nipple and the baby's mouth which generally is ingested into the baby's stomach which air has to be removed by burping or results in infant colic.

One of the solutions provided in the prior art of Stephenson, et al. U.S. Pat. No. 4,676,387 to reducing the amount of air during infant feeding is to provide a non-coaxial alignment of the center axis of the bottle with the center axis of the nipple by dividing the bottle into an upper part, which is in non-alignment, with the lower part of the bottle so that the axis of the upper part is inclined at an angle to the axis of the lower part of the bottle. This approach to solving the problem results in the necessity of utilizing a specially constructed baby bottle which is expensive to produce and difficult to clean since the angled neck of the bottle provides an inaccessible location for cleaning. In addition the non standard baby bottle of Stephenson, et al. '387 requires special handling, special construction and does not allow for adjustability since the angle of the axis is set in the bottle at the time of manufacture.

The baby bottle of Stephenson, et al. '387 furthermore can allow significant amounts of air to be drawn from the bottle during nursing since the bottleneck is of generally the same diameter at the upper portion and the lower portion of the baby bottle and does not include a channelling passage that is either tapered or offset to reduce the amount of air that can be drawn through the nipple. The absence or a channelling passage alone or in combination with the inability to use a disposable liner allows the introduction of air through the nipple which is centrally located to the upper portion of the modified bottle when the level of liquid in the bottle reaches a low level.

The invention in contrast to Stephenson, et al. '387 employs a standard infant nursing bottle with a standard nursing nipple and utilizes a specially designed neck which includes a channeling passage which may be tapered, offset or employ a liner to reduce the amount of air that can be drawn through the nursing nipple. The neck of the invention furthermore is adjustable which maintains a more perfect alignment between the volume of liquid in the bottle and the center axis of the standard nursing nipple.

Other prior art such as Klag, U.S. Pat. No. 5,190,174 employs a standard nursing bottle but employs a special nipple which has a corrugated or swivel portion which allows the nipple to bend between the bottleneck and the end of the nipple. Klag '174 unlike the invention does not utilize a standard nipple but instead modifies the nipple to make the rubber nipple bend to conform to a position where the nipple is substantially in alignment with the center line of the mouth of the infant. The corrugated nipple of Klag '174 is at its untensioned state in alignment with the center axis of the bottle. This arrangement may significantly reduce the amount of air drawn by the infant through the nipple from the bottle but instead allows air to be drawn through the sides of the mouth between the interface of the infant's mouth and the nipple due to the angular pressure placed between the nipple and the sides of the infant's mouth. In addition Klag '174 requires specialized nipples which include an internal corrugated portion which makes cleaning and sterilization of the nipple more difficult and the production of the nipples more expensive.

The invention unlike the prior art utilizes both standard bottles and standard nipples and does not require pressure or tension between the sides of the mouth of the nursing infant and the nipple to achieve its advantages. As a result the adjustable baby bottleneck of the invention results in lesser amounts of air being drawn into the infant's mouth during nursing from not only around the sides of the mouth but also through the bottle as a result of the manner in which the baby bottleneck provides an adjustment and a self maintenance of that adjustment which does not interfere with the natural interface between the baby's mouth and the nipple while providing a channelling for fluids inside the bottle to maintain a relationship between the liquid inside the bottle and the centerline of the nipple to reduce the amount of air that can be drawn into the baby's stomach during nursing.

Other prior art such as Cohen, et al. U.S. Pat. No. 4,969,564 and Garvin U.S. Pat. No. 5,234,117 have somewhat adjustable or angular bottlenecks which accommodate a bending between the bottle and the nipple. Cohen, et al. '564 however as indicated in FIG. 1 requires the infant to manually maintain the angle between the nipple and the bottle in order to prevent air from being entrained into the baby's mouth between the interface between the nipple and the infant's mouth. Garvin '117 has replaced the nipple with a straw-like delivery opening which replaces the standard nipple. In both Garvin and Cohen more mature infant's are required to utilized the apparatus of such prior art. On the other hand the apparatus of the present invention is readily utilizable by infant's of all ages.

Lawrence U.S. Pat. No. 4,813,556 like Stephenson, et al. U.S. Pat. No. 4,676,387 pertains to a specially constructed bottle which is without liners and difficult to clean and expensive to manufacture. Lawrence '556 employs the bellows for the removal of air when used with or without a liner which requires the bellows to have insufficient body to maintain a particular position in accordance with the invention.

The device of the invention unlike all of the prior art utilizes a standard baby nursing bottle at one end and a standard baby nursing nipple at the other end and imparts angular adjustability through a specially designed neck portion which is adjustable from an angle of about 0 to 60 degrees and which maintains that angular adjustment once the angular position is manually set by the person feeding the infant. This angular adjustment can be set at an infinite number of angles depending upon the posture of the infant during feeding, i.e. whether the infant is reclined, semi-reclined or sitting up.

The invention unlike the prior art reduces air drawn into the mouth through either the inside of the bottle or between the interface between the infant's mouth and the nipple by removing angular stress between the infant's mouth and the nipple and by providing a more perfect passage between the center line of the nipple with the liquid in the center line of the bottle. This arrangement ensures that when the milk inside drops to a low level the angular relationship between center line of the nipple and the center line of the bottle does not allow air to enter the infant's mouth through the center of the nipple. In addition and at the same time stress between the standard nipple and the angular relationships between the nipple and the bottle is carried primarily by the adjustable bottleneck so that the interface between the infant's mouth and the nipple does not provide tension which allows air to be entrained through the sides of the infant's mouth and thereby swallowed. These advantages are particularly beneficial since the advantages remain constant irrespective of the position of the infant once the person feeding the infant properly adjusts the adjustable bottleneck to accommodate the posture of the feeding infant.

The invention provides further advantages over the prior art in providing a completely disassemblable device which allows all parts to be easily cleaned without leaving corners and traps for food and bacteria. The invention further provides advantages in accommodating not only the standard nursing bottle but also bottles with liners which have also been used in recent years to reduce the amount of air drawn through the nipple from the bottle by allowing the liner to gradually collapse as the contents are drawn out through the nipple. In either of these applications the adjustable bottleneck of the invention utilizes standard nipples and standard bottles and allows the neck portion to be infinitely adjustable to the feeding posture of the infant and reduces the amount of air the infant can either draw from the bottle through the nipple or can draw into its mouth through the sides of the mouth between the interface between the nipple and the bottle to thereby reduce the amount of air the infant can consume while feeding. These advantages are achieved through an inexpensive adjustable bottleneck which is easily cleaned, fabricated and added to available on the shelf standard bottles and nipples to overcome the disadvantages and drawbacks of the prior art while providing significant benefits to feeding infants of all ages.

SUMMARY OF THE INVENTION

The invention provides an adjustable baby bottleneck which utilizes at one end a standard baby bottle either lined or unlined and which at the other end accepts a standard nursing nipple while allowing the neck to be infinitely adjusted and set in position for delivery of infant feeding formulas to reduce the amount of air drawn through the nursing nipple and around the sides of the mouth during feeding. The adjustable baby bottleneck is adaptable to all standard infant nursing bottles and nursing nipples and may be conveniently utilized with either lined or unlined standard bottles that are readily available for infants.

The adjustment and setting of the angle of the bend of the adjustable baby bottleneck allows the bottleneck to be adjusted to a feeding position to match the feeding posture of the infant from between a fully reclined infant position to an upright sitting position or a semi-reclined position such as in an infant car seat or baby carriage. The infinite degree of adjustment provided plus the ability to set and the adjustable bottleneck to retain a given adjustable position allows the utilization of a standard nursing bottle with a standard nipple while at the same time reducing the amount of air an infant can draw through the center of the nursing nipple from the interior of the bottle and reducing the amount of air the baby can swallow from drawing air from around the sides of the nipple between the interface of the nipple and the baby's mouth. This reduction in the amount of air drawn either from the bottle through the nipple or around the sides of the nursing nipple by the adjustment and maintaining of the adjustment in the adjustable baby bottleneck reduces belching, burping, colic and other infant disorders resulting from the introduction of excessive amounts of air into the infant's stomach during feeding.

The adjustable baby bottleneck allows the utilization of both lined and unlined standard baby bottles without requiring expensive modifications to either the infant bottle or the standard nursing nipples which generally require specialized tooling for the infant bottle and nursing nipple. The adjustable baby bottleneck of the invention may be conveniently utilized with standard liner type bottles which by their very nature have advantages in reducing the amount of air the infant can draw through the nursing nipple since the liner of such bottles gradually collapse during feeding. In such embodiments the primary source for the introduction of air into the infant's stomach is from the interface between the nursing nipple and the infant's mouth during nursing and swallowing. Even in the utilization of standard bottles with liners the amount of air introduced into the infant's stomach is reduced during nursing by providing a more natural angle between the nursing nipple and the center line of the bottle and utilizing a channelling passage that may be constricted or offset to channel fluids from the center of the bottle to at or slightly above the hole of the nursing nipple.

The more the nursing nipple is coaxial with the center line of the infant's mouth the less amount of air can be entrained around the sides of the baby's mouth during feeding. The adjustable baby bottleneck assists by providing an infinitely adjustable and settable means for positioning the nursing nipple parallel to the center axis of the baby's mouth irrespective of the baby's posture thereby reducing the amount of air introduced into the baby's stomach during feeding and reducing feeding disorders and discomfort. The ribs of the adjustable baby bottleneck provide the adjustment and setting of the baby bottleneck. A second set of ribs parallel or substantially parallel to the first set of ribs may be employed to assist in the adjustment and setting of the angular position of the adjustable baby bottleneck.

The adjustable baby bottleneck also advantageously employs an internal channelling which may be tapered or offset to assist in directing fluids from the center of the standard baby bottle to the center of the nursing nipple. The internal channelling alone or in combination with a taper or offset provides a more direct communication of fluids from the emptying bottle to at or near the centerline of the nursing nipple to reduce the incidence of air that can be drawn through the center of the nursing nipple.

The advantages of the invention are achieved by the utilization of a bottleneck which is either bendable or preset at an angle which employs a first end for receiving a standard nursing nipple with securing ring and a second end which receives the standard infant bottle. Disposed between the first end and second end of the bottleneck includes internal channeling means for directing feeding fluids from the standard nursing bottle and collecting them for distribution at or slightly above the center of the nursing nipple. In the best mode of the invention the channelling means is utilized in the adjustable baby bottleneck to direct fluids to the center of the nipple or a separate disposable liner is placed inside the bottleneck to more effectively channel feeding fluids to the center of the standard nursing nipple.

As indicated the invention is utilized with standard baby bottles and standard nursing nipples with or without disposable liners and provides an angular bottleneck addition which collects and directs feeding fluids from the baby bottle to the nursing nipple in a more efficient manner. The bendable and infinitely adjustable bottleneck allows the utilization of standard baby bottles and standard nipples to allow for angular adjustment in the bottleneck adaptor to accommodate an infinite variety of infant feeding postures while reducing the amount of air an infant may ingest either through the nursing nipple from the bottle or from around the sides of the mouth from the interface between the infant's mouth and nursing nipple. These and other advantages of the invention including the advantages in utilizing standard baby bottles and nursing nipples as well as the advantages in providing an easily cleanable nursing device will become apparent from the following description of the drawings in conjunction with the detailed description of a preferred embodiment and best mode.

BRIEF DESCRIPTION OF THE DRAWING

The objects and advantages of the invention will become more readily understood from the following detailed description of the invention along with the appended claims when read in conjunction with the accompanying drawings in which:

FIG. 4 is an exploded perspective view of the top portion of FIG. 1;

FIG. 5 is a bottom plan view of FIG. 4;

FIG. 6 is a cross sectional view of the adjustable bottleneck portion of FIG. 4;

FIG. 10 is an exploded perspective view partly in section of an alternative embodiment of the preferred form of the invention;

FIG. 11 is a bottom plan view of FIG. 10;

FIG. 12 is a cross sectional view of FIG. 10;

DESCRIPTION OF A PREFERRED EMBODIMENT AND BEST MODE

Figure 1:
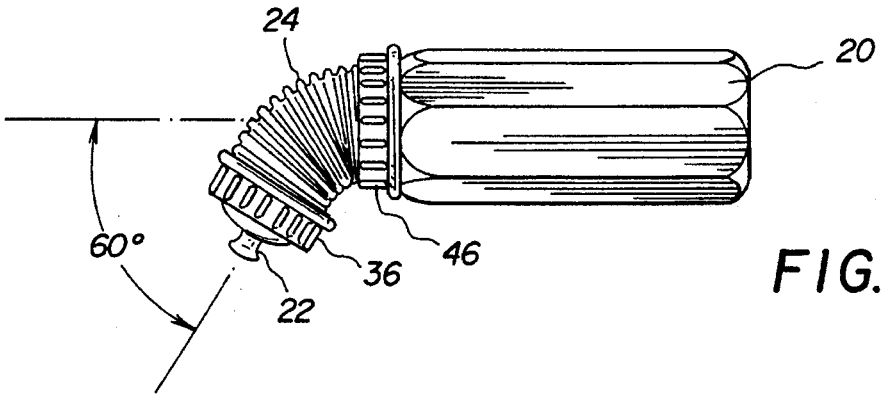
FIG. 1 is a side elevational view of the preferred embodiment of the adjustable baby bottleneck invention.
Figure 2:
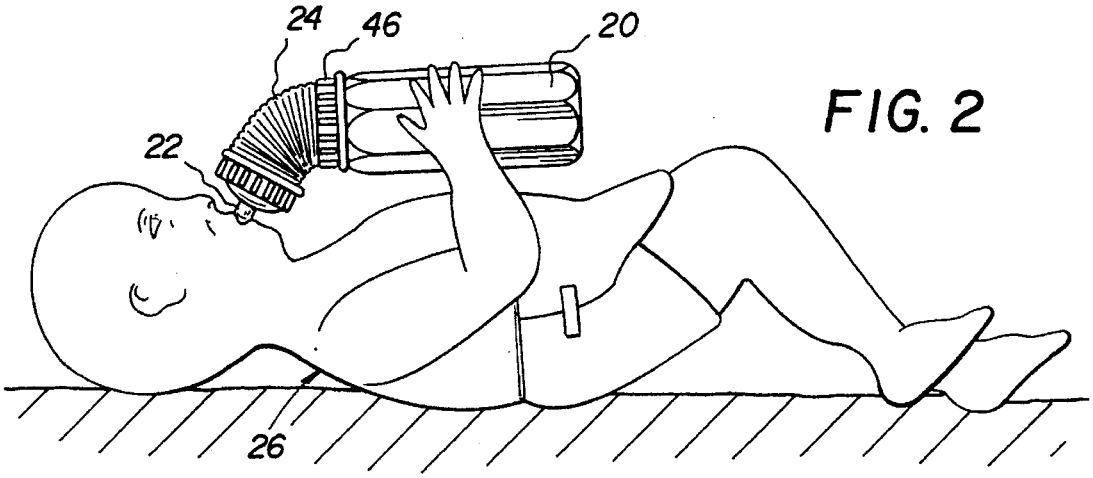
FIG. 2 is a pictorial view illustrating an application of the invention as shown in FIG. 1.

Referring now to FIG. 1 a conventional baby bottle 20 having a conventional nipple 22 is illustrated with an adjustable baby bottleneck 24. The adjustable baby bottleneck 24 is constructed of a flexible plastic material which may be adjusted in an infinite number of positions between 0 and 60 degrees and once adjusted maintains the particular angular position with respect to the conventional baby bottle 20. The adjustment of the adjustable baby bottleneck 24 allows the neck portion of the bottle to be adjusted and placed in a variety of positions such as reclined position 26, FIG. 2, as illustrated in FIG. 2 or in upright position 30 as illustrated in FIG. 3 or in any position therebetween.

Figure 3:
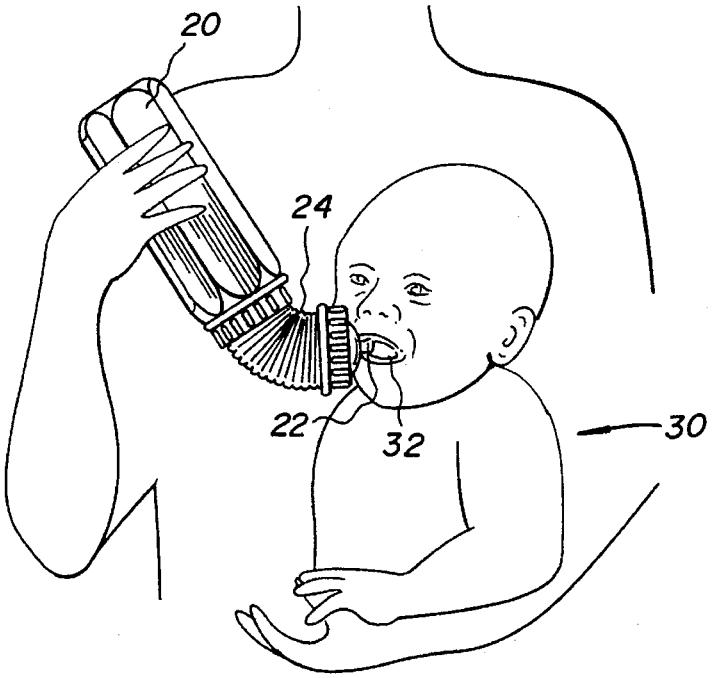
FIG. 3 is a further pictorial view illustrating a further application of the invention of FIG. 1.

The adjustable baby bottleneck 24 thereby provides a natural curvature for the delivery of baby formula to the infant since the adjustment and the maintenance of that adjustment is maintained by the adjustable baby bottleneck 24 which allows feeding fluids inside the bottle to flow to the center axis of the baby nipple 22 and prevent the introduction of air into the baby's stomach during feeding as well as providing a better interface between the nipple 22 and the baby's mouth 32 to provide for the parallel alignment of nipple 22 with the center axis of the baby's mouth 32 (FIG. 3).

Referring now to FIGS. 1, 2, 3, 4, 5 and 6 the adjustable baby bottleneck 24 is illustrated employing a conventional bottle 20 and a conventional nipple 22. The conventional nipple 22 includes an opening 34 which is in general alignment with the center axis of the nipple 22. The conventional nipple 22 includes a securing ring 36 having a ribbed portion 38 which is used to secure internal threads of the securing ring 36 to the conventional bottle 20. In accordance with the invention conventional nipple 22 and securing ring 36 is secured to adjustable baby bottleneck 24 at the upper end 40 through external threads 42 which engage the internal threads of securing ring 36. At the lower end 44 a mounted securing ring 46 is disposed having ribs 48 and internal threads 54 of the same size and matching configuration of the threads of securing ring 36. Securing ring 46 and threads 54 are designed to engage matching threads on conventional bottle 20 to secure the adjustable baby bottleneck to the conventional baby bottle.

The angular position of adjustable bottleneck 24 is maintained by annular ribs 25 which alone or together with substantially perpendicular ribs 27 are utilized to set and maintain the angular position of adjustable bottleneck 24 for a particular infant feeding position. A plurality of substantially perpendicular ribs 27 may be provided in an annularly opposing configuration as illustrated in FIGS. 5 and 6.

Figure 7:
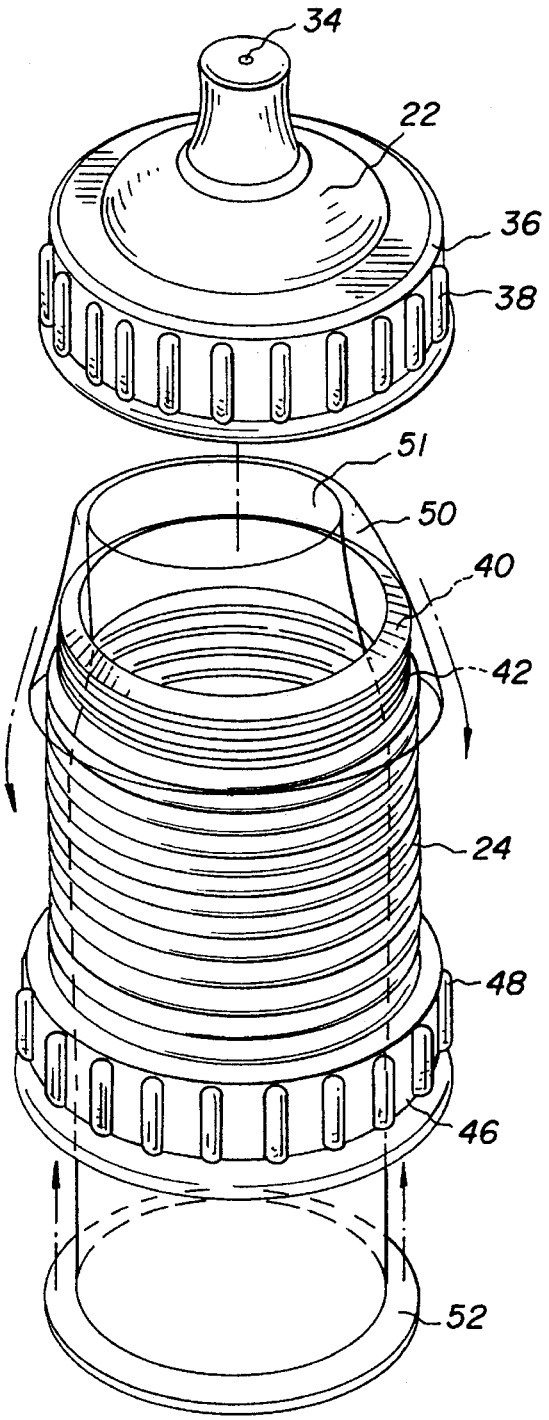
FIG. 7 is an exploded perspective view of the adjustable bottleneck portion of FIG. 1 with the addition of a disposable adjustable bottleneck liner constructed in accordance with the invention.
Figure 8:
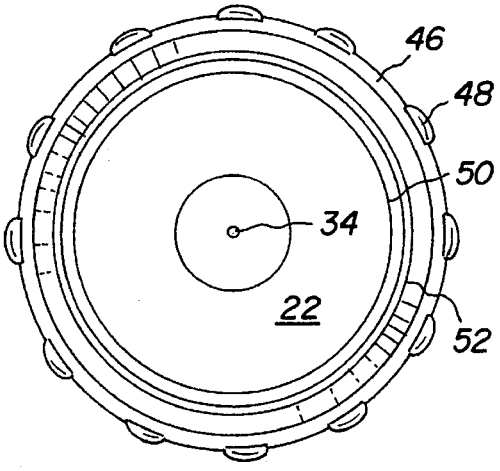
FIG. 8 is a bottom plan view of FIG. 7.
Figure 9:
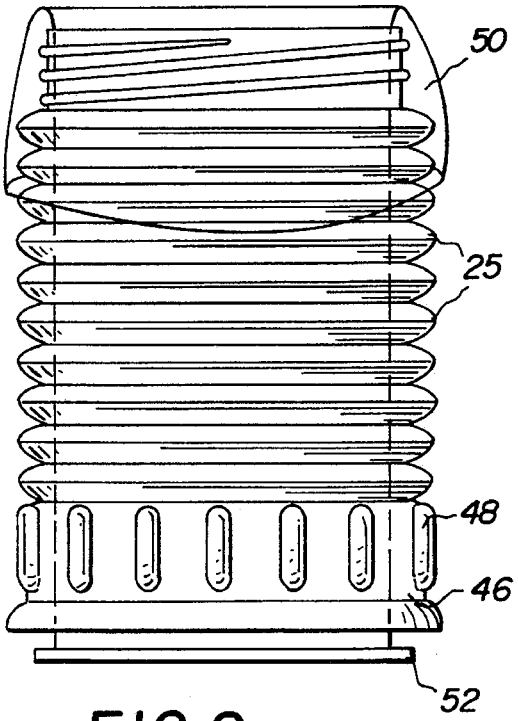
FIG. 9 is a side elevational view partly in section of FIG. 7.
Figure 13:
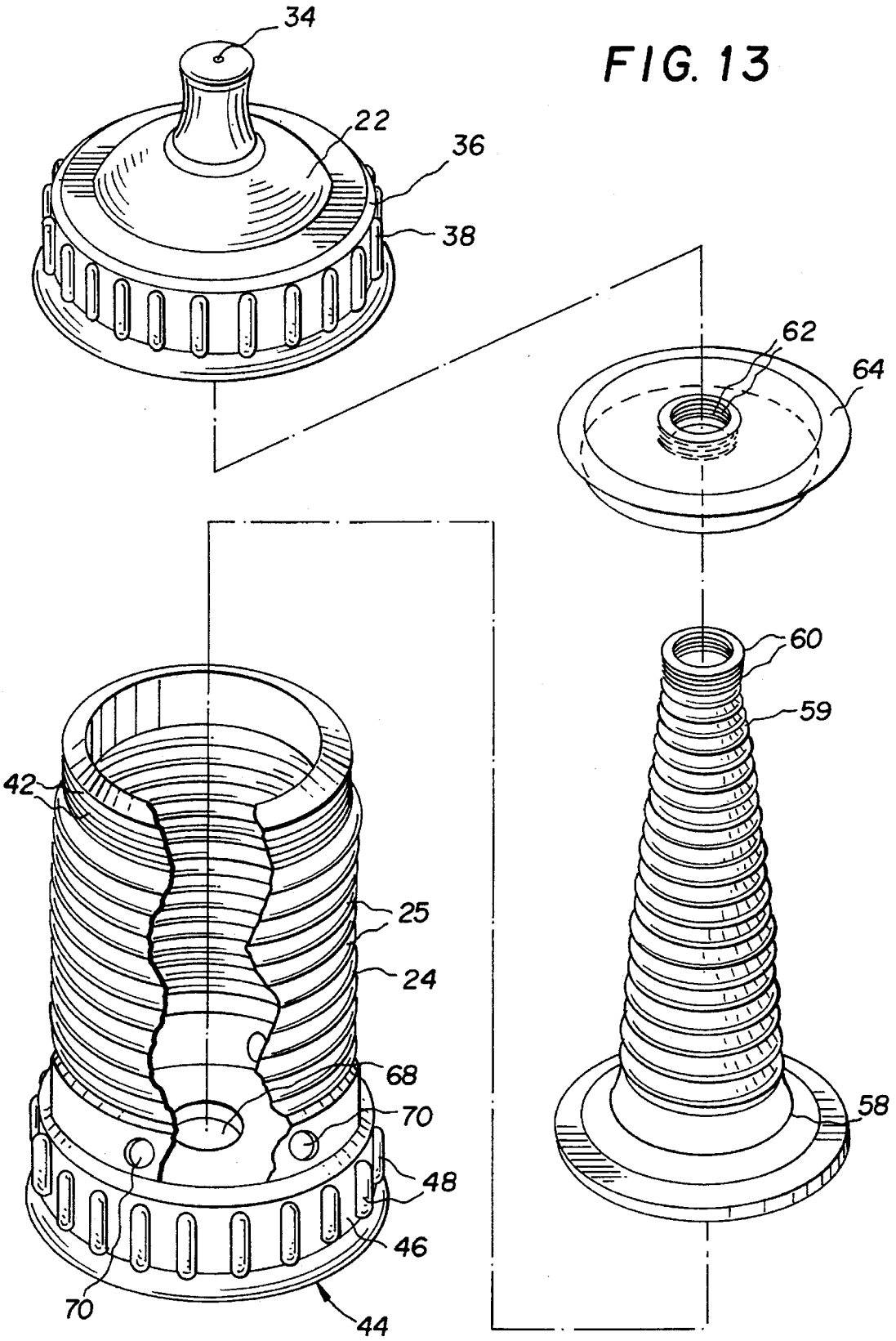
FIG. 13 is an exploded perspective view partly in section number to FIG. 10 illustrating the tapered channelling passage.
Figure 14:
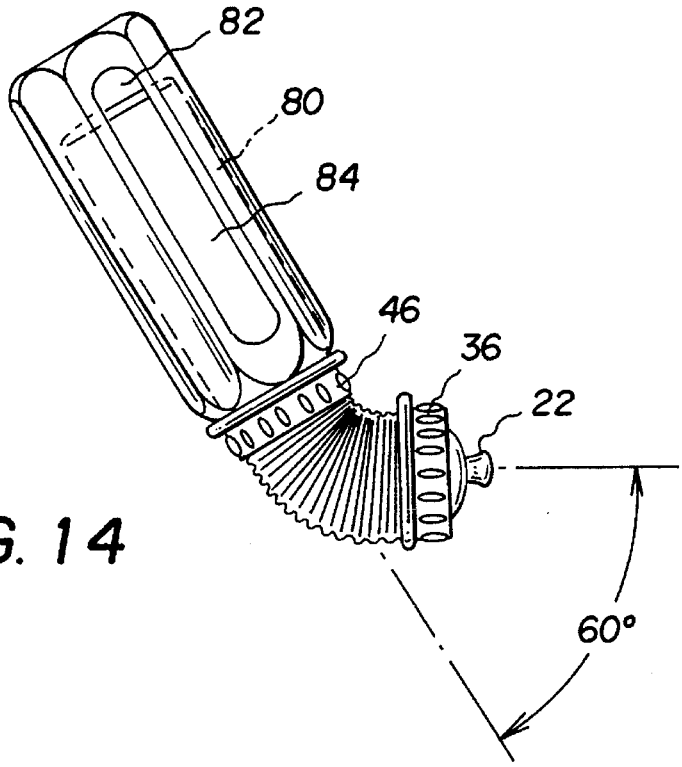
FIG. 14 is a side elevational view of the invention utilizing a standard baby bottle having a standard disposable liner.

Referring now to FIGS. 1, 7, 8 and 9 the adjustable baby bottleneck 24 can be used with conventional baby bottles with and without liners as well as with the utilization of a special disposable adjustable baby bottleneck liner 50 (FIG. 7). Disposable adjustable baby bottleneck liner may be tapered at the top end 51 to assist in channelling feeding fluids to the center of conventional nipple 22. As will be recognized by those skilled in the art the adjustable baby bottleneck 24 may be used with conventional liners as will be hereafter described in greater detail with respect to FIGS. 15, 16 and 17 or may be used with a specially designed liner 50 having at one end a gasket 52 which terminates in the liner 50 which may be disposed through the adjustable baby bottleneck 24 as illustrated in FIG. 7. The annular ribs 25 may be axially compressed to assist in the threading through of liner 50. Gasket 52 is designed to mate with the inside of mounted securing ring 46 above threads 54 to provide a secure seal when adjustable baby bottleneck 24 is threadably attached to conventional bottle 20.

Referring now to FIGS. 10–13 an adjustable baby bottleneck 24 in its preferred embodiment is illustrated. In the best mode a flexible channeling tube 56 having at one end a gasket 58 (FIG. 13) and at the other end an externally threaded portion 60 for engaging threads 62 of upper gasket 64. Channelling tube 56 may be tapered (FIG. 13) at its upper end 59 to assist in directing fluid from inside the bottle to at or near the center of conventional nipple 22. Gasket 58 is designed for threading through an opening 68 at lower end 44 of adjustable baby bottleneck 24.

Once channelling tube 56 is threaded through opening 68 threads 62 of upper gasket 64 are attached to threads 60 of channelling tube 56 to provide an airtight communication between the inside of conventional bottle 20 with opening 34 of conventional nipple 22. Openings 70 may be provided in adjustable baby bottleneck 24 to admit air to assist in the adjustment of adjustable baby bottleneck 24 to maintain a particular position. Openings 70 prevent the creation of an airtight chamber between the outside of channelling tube 56 and the inside of adjustable baby bottleneck 24 to allow the adjustable baby bottleneck to be deformed and set to a particular feeding position.

The function of channelling tube 56 is to accomplish a more perfect communication between fluids and feeding materials inside conventional bottle 20 and the center axis of conventional nipple 22. In operation the smaller diameter channelling tube directs fluid from conventional bottle 20 in a more constricted passage so that fluid is maintained for the longest possible time in a substantially perpendicular alignment to opening 34 thereby reducing the amount of air an infant can draw from the inside of conventional bottle 20 during feeding. The channelling provided by channelling tube 56 performs a function similar to the collapsible conventional liners.

The channelling provided by channelling tube 56 as well as liners 50 and conventional liners serve the purpose of reducing the amount of air the infant can draw into the mouth through the bottle during feeding. In addition the adjustable flexibility imparted by the adjustable baby bottleneck 24 in setting in particular position to conform to the posture of the feeding infant also prevents the infant from drawing air in from the sides of the mouth between the interface between the nipple and the infant's mouth. The combination of these two features reduces the amount of air an infant can ingest utilizing either a conventional bottle without a liner or a conventional bottle with a liner.

Figure 15:
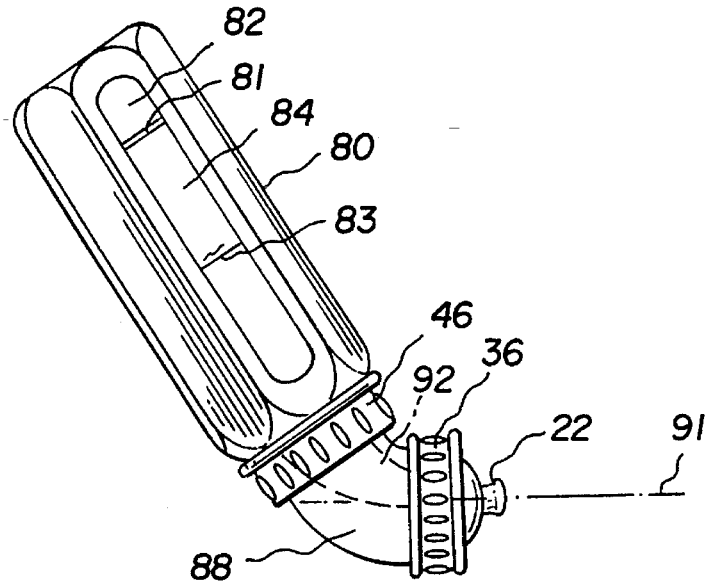
FIG. 15 is a side elevational view of a further embodiment of the invention utilizing a standard baby bottle having a standard disposable liner.
Figure 16:
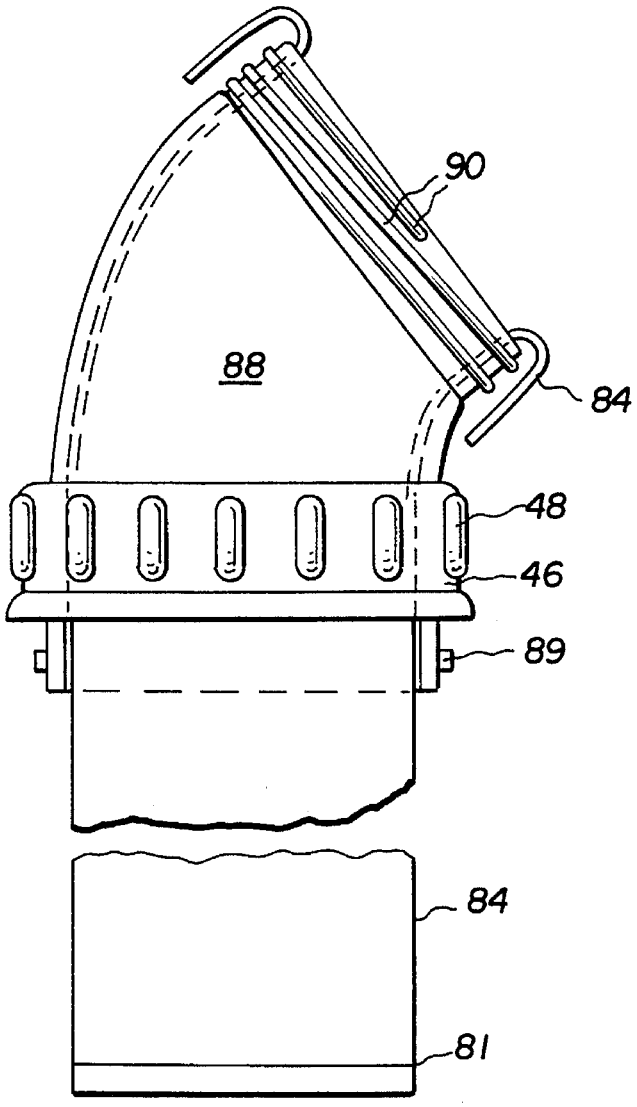
FIG. 16 is a side elevational view of the bottleneck portion of FIG. 15 with a liner.
Figure 17:
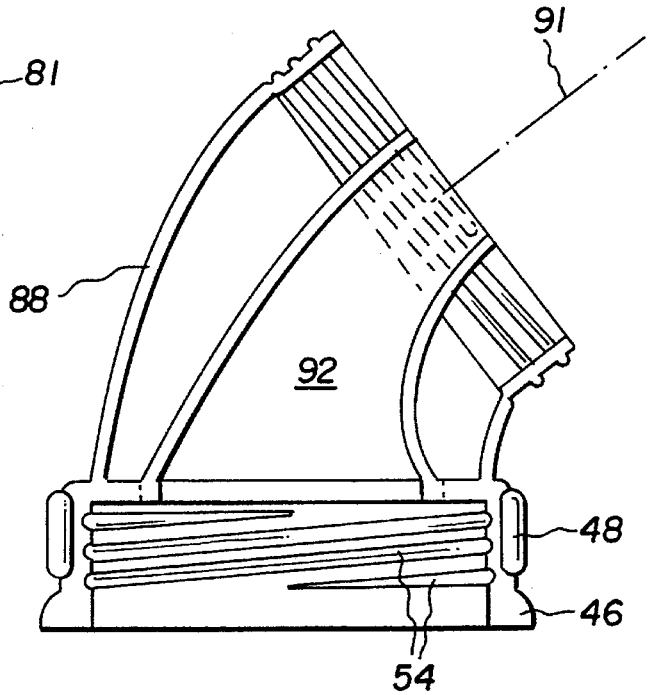
FIG. 17 is a side elevational view partly in section of the neck portion of FIG. 15.

Referring now to FIGS. 14, 15, 16 and 17 a conventional liner bottle 80 having a sealed end 81 is illustrated having openings 82 which allow a collapsible liner 84 to gradually collapse as the infant draws fluid 83 from conventional nipple 22. The conventional liner 84 may be utilized with the adjustable baby bottleneck 24 in a manner similar to that illustrated in FIG. 7 except for the utilization of collapsible conventional liner 84 in place of liner 50 in FIG. 7. Conventional liner bottle 80 merely provides a rigid shell for holding liner 84 which is designed to gradually collapse while it directly supplies fluid to nipple 22 and reduces the volume of air the infant can ingest from the bottle during feeding. In the embodiment of the invention as illustrated in FIGS. 15, 16 and 17 an angled bottleneck 88 is provided for accepting collapsible conventional liner 84. Angled bottleneck 88 includes on the top end threads 90 for engaging securing ring 36 containing conventional nipple 22. Securing ring 36 may be screwed down over the end of the liner 84 to maintain liner 84 within angled bottleneck 88 and conventional liner bottle 80.

A mounted securing ring 46 having ribs 48 is provided at the other end of bottleneck 88 which secures bottleneck 88 to a conventional liner bottle 80 by means of annular flange 89 and matching threads on conventional liner bottle 80. The collapsible nature of liner 84 maintains a direct channelling of feeding fluids directly to opening 34 of conventional nipple 22. In an alternative embodiment the same process of channeling fluids from a conventional bottle to opening 34 may be achieved by a funnel shaped or tapered channel 92 which may be offset to a position slightly above the centerline 91 within the inside diameter of angled bottleneck 88. In this manner air from inside a conventional bottle, whether lined or unlined, can be significantly reduced from being drawn through opening 34 while the infant is feeding. In addition the adjustable and angled nature of the adjustable baby bottleneck prevents air from being drawn between the interface of the feeding infant's mouth and the conventional nipple.

Those skilled in the art will recognize the adjustable baby bottleneck provides for the improved feeding of infant's by accommodating virtually any feeding posture of the infant while reducing the amount of air that can be ingested by the infant through the interface between the nipple and the infant's mouth as well as through the conventional nipple. The invention furthermore utilizes conventional bottles with and without liners and conventional nipples and does not require expensive construction or fabrication of either the bottle or the nipple and allows for easy disassembly and cleaning.

Those skilled in the art will further appreciate a number of modifications and variations that can be made to the invention within the spirit and scope of the invention as described in the preferred embodiments. It is intended the following claims cover such all alterations and modification as may be made within the true spirit and scope of the invention.

What is claimed is:

1. A baby bottleneck adaptor for use with a conventional baby bottle and a conventional nipple comprising:

(a) a plastic body having a first end with an opening therein and a second end with an opening therein, said opening in said first end communicating with said opening in said second end, said second end having means for mounting a securing ring, said plastic body having means for providing and maintaining a non coaxial alignment of said opening in said first end with said opening in said second end;

(b) external threads at said first end for engaging threads of a securing ring of a conventional baby bottle nipple;

(c) a mounted securing ring mounted at said second end having internal threads for engaging threads of a conventional baby bottle and (d) a liner having an opening first end and an open second end terminating in means for mating with said mounted securing ring.

2. The baby bottleneck adaptor of claim 1 further comprising a channelling passage having a larger sized opening in said second end and tapering to a smaller sized opening in said first end.

3. The baby bottleneck adaptor of claim 2 wherein the center of said smaller sized opening f said channelling passage is offset from the center of said larger sized opening of said channelling passage.

4. The baby bottleneck adaptor of claim 1 wherein said means for providing and maintaining a non coaxial alignment of said opening in said first end with said opening in said second end is a plurality of annular ribs axially disposed between said first end and said second end of said plastic body.

5. The baby bottleneck adaptor of claim 4 further comprising holes disposed in said plastic body.

6. The baby bottleneck adaptor of claim 1 wherein the center axis of said opening in said first end of said plastic body is adjustable to an angle of about 15 to 60 degrees from the center axis of said opening in said second end of said plastic body.

7. The baby bottleneck adaptor of claim 1 wherein the center axis of said opening in said first end of said plastic body is offset from said center axis of said opening in said second end of said plastic body.

8. An adjustable baby bottleneck adaptor for use with a conventional baby bottle and a conventional nipple comprising:

(a) a ribbed radially adjustable and settable plastic body having a first end with an opening therein and a second end with an opening therein said ribbed radially adjustable settable plastic body having a density capable of adjusting and maintaining a variety of angular positions;

(b) a channelling passage connecting said opening in said first end with said opening in said second end said channeling passage tapering from said second end to said first end;

(c) means at said first end of said plastic body for engaging a securing ring of a conventional baby bottle nipple and means at said second end of said plastic body for mounting a securing ring; and (d) a mounted securing ring mounted at said second end of said plastic body for engaging the top of a conventional baby bottle.

9. The adjustable baby bottleneck adaptor of claim 8 wherein said means at said first end of said plastic body for engaging a securing ring is external threads.

10. The adjustable bottleneck adaptor of claim 9 wherein said mounted securing ring at said second end of said plastic body includes internal threads for engaging said top of said conventional baby bottle.

11. The adjustable bottleneck adaptor of claim 10 wherein said ribbed radially adjustable and settable plastic body is adjustable and settable from an angle of about 0 to 60 degrees as measured from the center of said opening in said first end to the center of said opening in said second end.

12. The adjustable bottleneck adaptor of claim 10 wherein said disposable liner defines said channelling passage.

13. The adjustable bottleneck adaptor of claim 12 wherein said disposable liner has an open first end and a sealed second end.

14. The adjustable bottleneck adaptor of claim 12 wherein said disposable liner has an open first end and an open second end terminating in a washer for mating with said mounted securing ring.

15. The adjustable bottleneck adaptor of claim 10 wherein said channelling passage includes a first end and a second end, said second end of said channelling passage terminating in a washer for mating with said mounted securing ring and a second washer for securing said first end of said channelling passage to said securing ring of said conventional baby bottle nipple.

16. A bottleneck adaptor for use with a conventional baby bottle and a conventional nipple comprising:

(a) a curvilinear plastic body having a first end terminating in external threads for engaging the threads of a securing ring of a conventional baby bottle nipple and a second end terminating in a flange;

(b) a mounted securing ring mounted at said flange at said second end of said curvilinear plastic body;

(c) a passage having a first end and a second end disposed between said first end and said second end of said curvilinear plastic body said passage tapering from said second end to said first end wherein the center axis of said passage at said first end is at an angle of about 15 to 60 degrees from the center axis of said passage at said second end.

17. The bottleneck adaptor of claim 16 wherein said center axis of said passage at said first end of said passage is offset from the center axis of said first end of said curvilinear plastic body.

18. A baby bottleneck adaptor for use with a conventional baby bottle and a conventional nipple comprising:

(a) a plastic body having a first end with an opening therein and a second end with an opening therein, said opening in said first end communicating with said opening in said second end, said second end having means for mounting a securing ring, said plastic body having means for adjusting and maintaining a non coaxial alignment of said opening in said first end with said opening in said second end;

(b) an internal channelling passage in said plastic body having a larger sized opening communicating with said second opening in said plastic body and a smaller sized opening communicating with said first opening in said plastic body said larger sized opening tapering to said smaller sized opening said internal channelling passage disposed in said plastic body at said means for adjusting and maintaining a non coaxial alignment of said opening in said first end with said opening in said second end of provide means for adjusting and maintaining a non coaxial alignment of said larger sized opening with said smaller sized opening in said internal channelling passage;

(c) external threads at said first end for engaging threads of a securing ring of a conventional baby bottle nipple; and (d) a mounted securing ring mounted at said second end having internal threads for engaging threads of a conventional baby bottle.

19. The baby bottleneck adaptor of claim 18 wherein said internal channelling passage is detachable from said plastic body.

20. The baby bottleneck adaptor of claim 18 further comprising a disposable liner.

* * * * *